US005519593A

United States Patent [19]

Hasness

[11] Patent Number: 5,519,593

[45] Date of Patent: May 21, 1996

[54] METHOD AND APPARATUS FOR HANDLING A LIGHTWAND

[75] Inventor: Richard S. Hasness, Longhone, Pa.

[73] Assignee: WalterScott International Corp., Bensalem, Pa.

[21] Appl. No.: 474,080

[22] Filed: Jun. 7, 1995

Related U.S. Application Data

[63] Continuation-in-part of Ser. No. 195,476, Feb. 14, 1994, Pat. No. 5,440,465.

[51] Int. Cl.[6] ..... F21L 7/00

[52] U.S. Cl. ..... 362/186; 362/103; 362/190; 362/208; 362/293

[58] Field of Search ..... 362/103, 186, 362/190, 191, 202, 208, 253, 311, 352, 355, 293; 220/2.1; 206/573; 340/815.73, 815.74, 815.75

[56] References Cited

U.S. PATENT DOCUMENTS 4,782,433 11/1988 Rombough ..... 362/186

5,383,103 1/1995 Pasch et al. ..... 362/186 X 5,392,203 2/1995 Harris, Jr. ..... 362/186

*Primary Examiner*—Stephen F. Husar

*Attorney, Agent, or Firm*—Hoffman, Wasson & Gitler

[57] ABSTRACT

A combination lightwand/holster device, involving a flashlight and a cone shaped diffuser element. When not in use as a lightwand, the cone shaped diffuser element expands, as it serves as a holster for the flashlight. Once the flashlight is removed from the holster, the distal end of the cone shaped diffuser element curls around itself, resulting in a more cone-like configuration, which beneficially imparts an enhanced degree of directional acuity to an observer, when the device is used as a directional lightwand. The diffuser element which has longitudinally extending openings or slits running along its length, provides better retention of the flashlight when carried in the holster, as well as providing easier insertion and removal of the flashlight.

6 Claims, 6 Drawing Sheets

METHOD AND APPARATUS FOR HANDLING A LIGHTWAND

This is a continuation-in-part of application Ser. No. 08/195,476 filed on Feb. 14, 1994 U.S. Pat. No. 5,440,465.

BACKGROUND OF THE INVENTION

1. Field of the Invention

The present device relates to illuminated safety devices, particularly hand-held presence or position indicators, manually-operated traffic control devices, and the like.

2. Discussion of the Prior Art

Providing a means of effectively directing vehicular traffic has long been a problem for modern living. Devices have long been available that are commonly referred to as light or traffic wands. These are usually specific-purpose, dedicated units that contain their own self-powered light source, or are separate devices that attach to a flashlight, such that the flashlight serves as the light source. Except for the "rear end storage" of a "Collapsible Light Wand" described in U.S. Pat. No. 4,697,228, the prior art light/traffic wands are devices having a single function, and both before and after use of that specific function, the device must be retrievably stored someplace, for later re-use. This, in many instances, turns out to be quite a nuisance, since these items can so easily become lost or misplaced.

Consider U.S. Pat. No. 3,418,651 to Jacobson. His device is a colored plastic package for holding a flashlight, wherein the package can be positioned over the light projecting end of the flashlight to form a signalling device. But, Jacobson's device does not provide a reliable and secure positioning arrangement for the flashlight, either while the flashlight is in the package or while the package is positioned for signalling usage. Moreover, the shape of Jacobson's package, by being flat and elongated, is not well suited for use as a lighwand, which is most easy to use when the lighwand has a conical shape.

U.S. Pat. No. 2,581,784 to Burdick discloses a signal attachment for a conventional flashlight, where the signal attachment is a sheath-like, flexible member made of transparent or translucent material. The signal member is folded around a longitudinal axis so as to form a tubular configuration when attached to the flashlight. When not in use, the signal attachment may remain attached but folded over the forward end of the flashlight. However, Burdick's signal attachment cannot serve as a holster or casing for the flashlight when not being used for signalling purposes. Thus, the problem of what to do with the signal attachment and flashlight when not in use remains.

Consider also U.S. Pat. No. 3,622,776 to Wyrick which discloses an auction light made up of a flashlight, a cone and a hollow, open-ended circular cylinder. When not in use, the cylinder can be slid forwardly into the cylinder to form a compact structure. When in use though, the user aims the open end of the cylinder at an auctioneer so that a light beam from the flashlight is projected through the open end of the cylinder. It can be plain seen that Wyrick's device is rather awkward to use and is not the most compact of devices. In addition, Wyrick's device can not serve to store the flashlight.

SUMMARY OF THE INVENTION

It is an object of the invention to provide a holster and a lightwand in a combined device.

It is a further object of the invention to offer a combined lightwand and holster device that can be produced with a reduced number of parts and at a beneficially lower cost.

It is still a further object of the invention to provide a combined lightwand and holster device that can be easily carried, handled and manipulated.

It is yet another object of the invention to offer a combined light wand and holster device where the flashlight can be removed from the holster quickly.

It is another object of the invention to provide a combined lightwand and holster device wherein the lightwand portion has a conical shape.

These together with other objects and advantages which will become subsequently apparent reside in the details of construction and operation as more fully hereinafter described and claimed, reference being made to the accompanying drawings forming a part hereof, wherein like numerals refer to like parts throughout.

DETAILED DESCRIPTION OF THE PREFERRED EMBODIMENT

The instant application is a Continuation-in-Part of U.S. patent application Ser. No. 08/195,476, filed Feb. 14, 1994, which is incorporated herein by reference.

The subject invention 12, hereinafter also referred to in the alternative as a holster-wand, is lightweight, easy to use, simple to manufacture, and generally economical.

Figure 1:
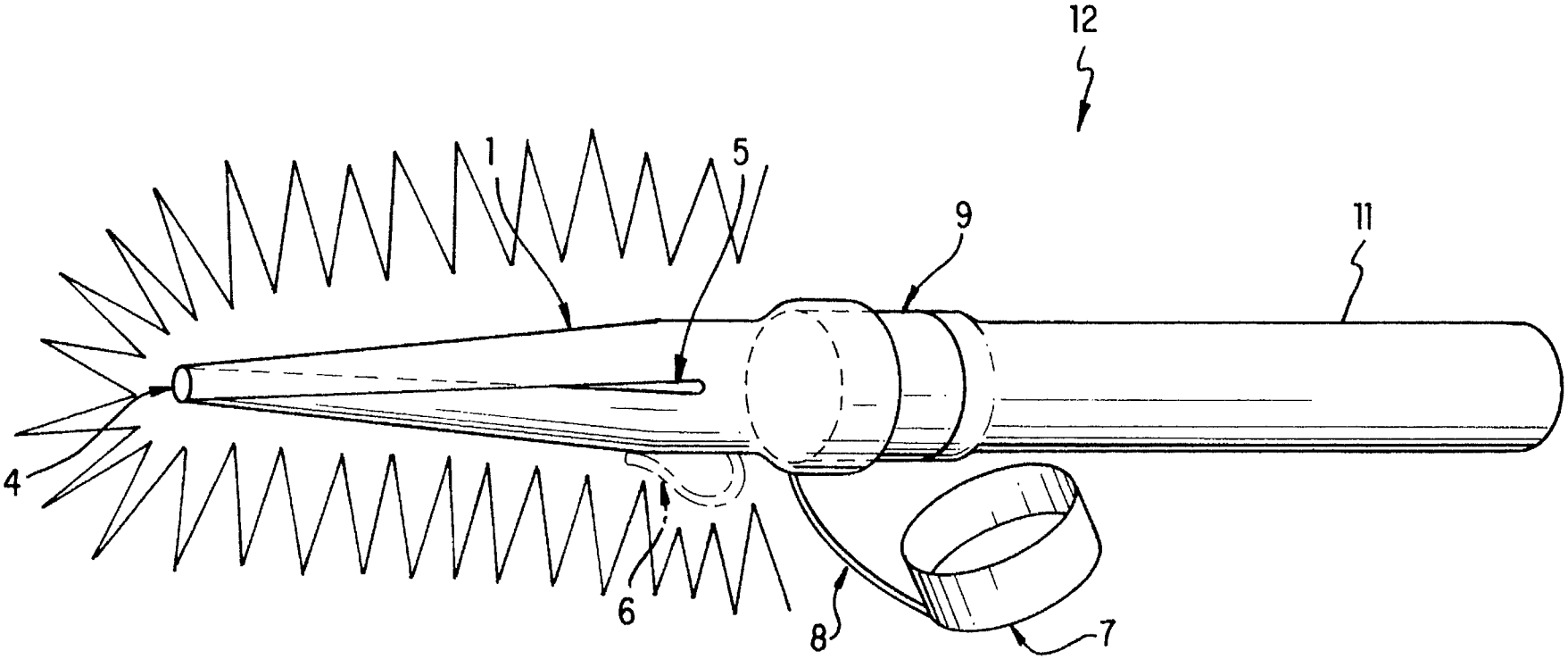
FIG. 1 shows an overall view of Applicant's device in its operable configuration.

As can plainly be seen in FIG. 1, the holster-wand 12 has several main components. The light-wand component is designated as 1. It is essentially a flexible, shaped receptacle, made of a resilient, light diffusing material such as a molded transparent or semi-transparent plastic, having optimal optical and light diffusing properties. The color of the lightwand 1 may be chosen from the field of well-known safety colors, such as blaze orange, green or yellow. In fact, the color chosen may be selected so as to identify the user or an organization to which he or she belongs. For instance, the ground crew workers of a particular airline may choose a light-wand 1 color such as green, while the ground crew workers of a competing airline may choose yellow as their light-wand color. The lightwand component 1 is provided with an integrally molded, necked down section, which provides a wedged function to facilitate removable securement of the head of the flashlight 11.

A conventional flashlight, which is to be used with Applicant's invention is designated as 11. The flashlight 11 is a typical flashlight having a circular cross-section, and internally provided with dry cell batteries, a light bulb and an on/off switch of some type, all of which are not shown.

Figure 2:
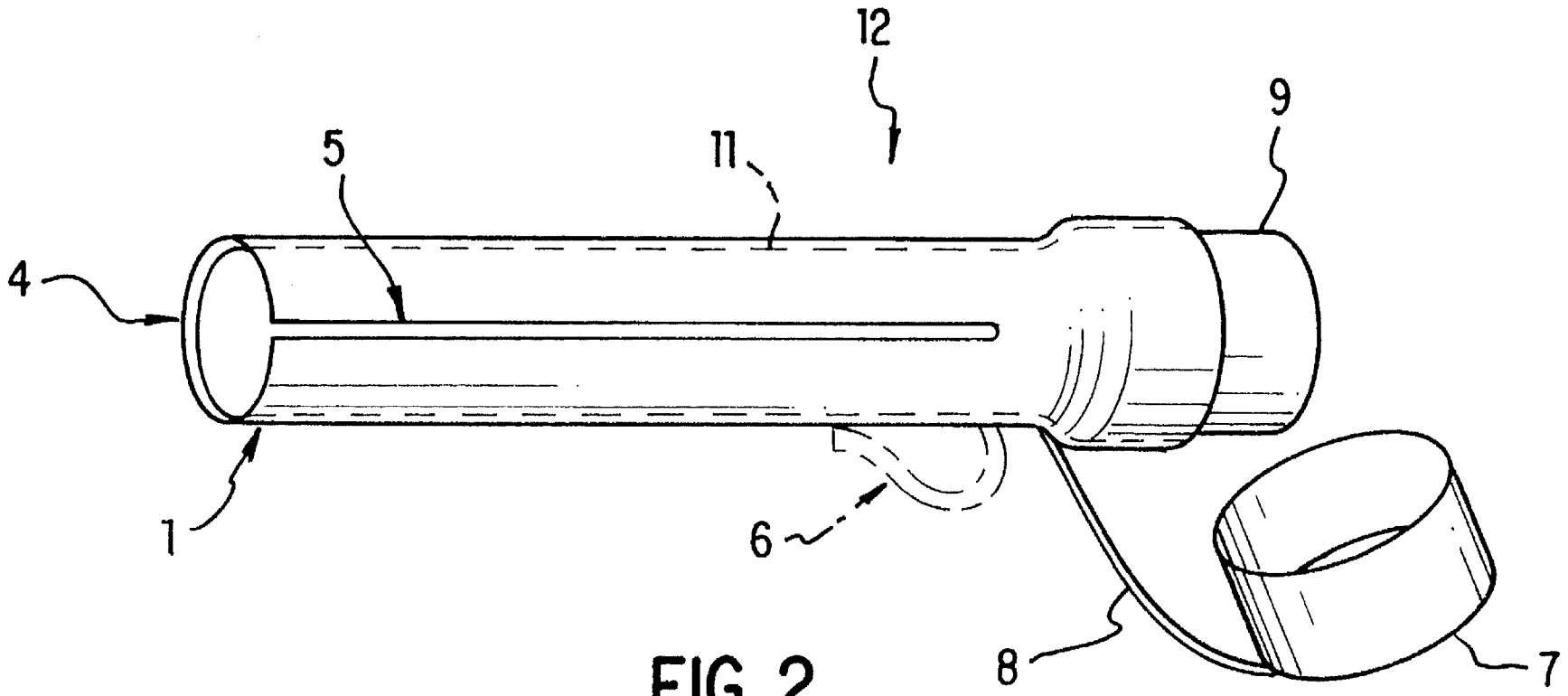
FIG. 2 shows Applicant's device in its holstered configuration.

Thus, in the useful position as a lightwand, the component 1 mates with the light projecting end 9 of the flashlight 11 in a snug and secure manner, and the component 1 is held in place on the light projecting end 9 of the flashlight 11 by physical, also called interference, fit. However, with an adequate amount of force, the lightwand component 1 and the flashlight 11 can be separated, so that the flashlight 11 can then be stored within the component 1, as shown in FIG. 2.

A cap 7 is provided to cover the lighwand component 1 when the device 12 is not in use. The cap 7 may be transparent or translucent, as will be discussed later, in reference to FIGS. 3 and 4. The cap 7 is attached to the lightwand component by a strap or tether 8, which will also be elaborated upon later.

Figure 5:
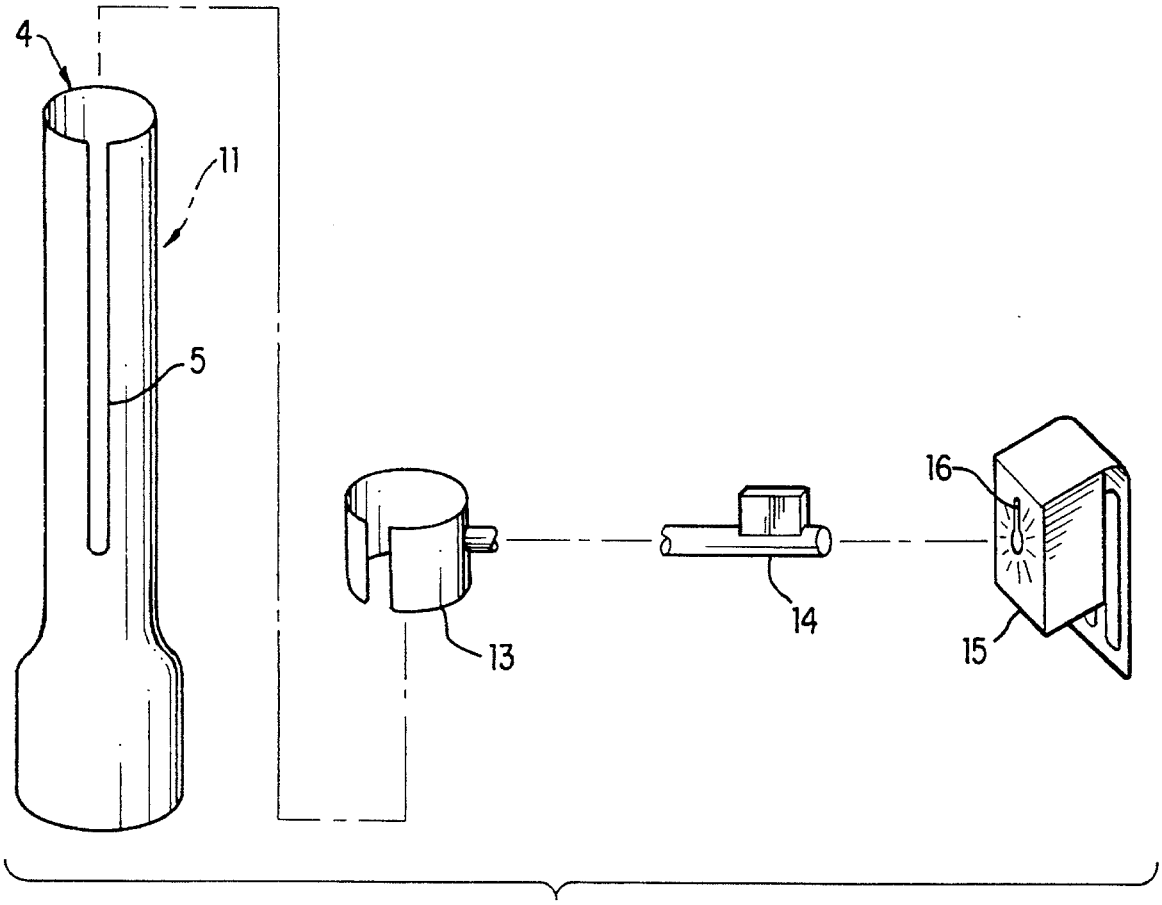
FIGS. 5–7 show other clip means.
Figure 6:
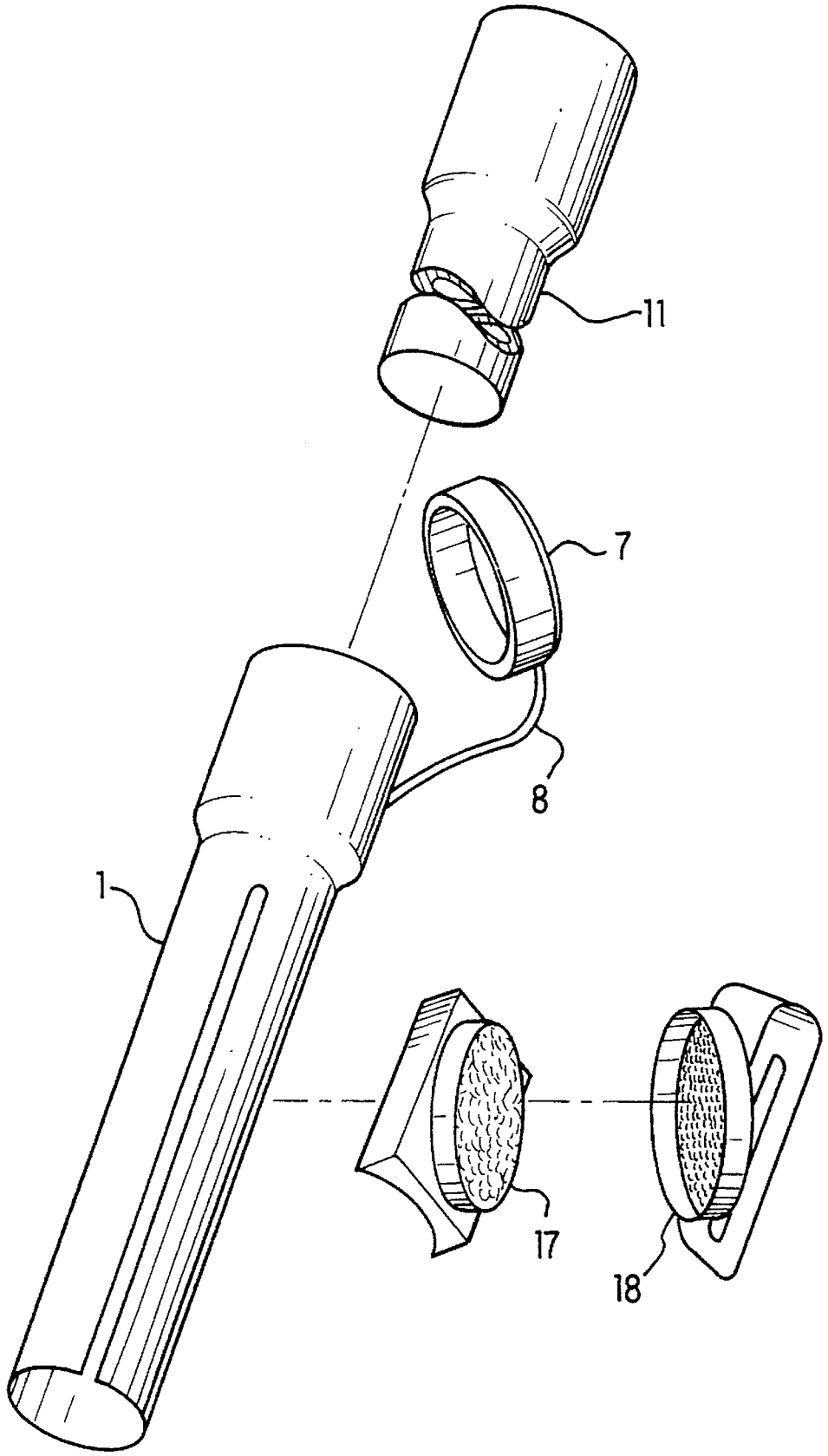
Figure 7:
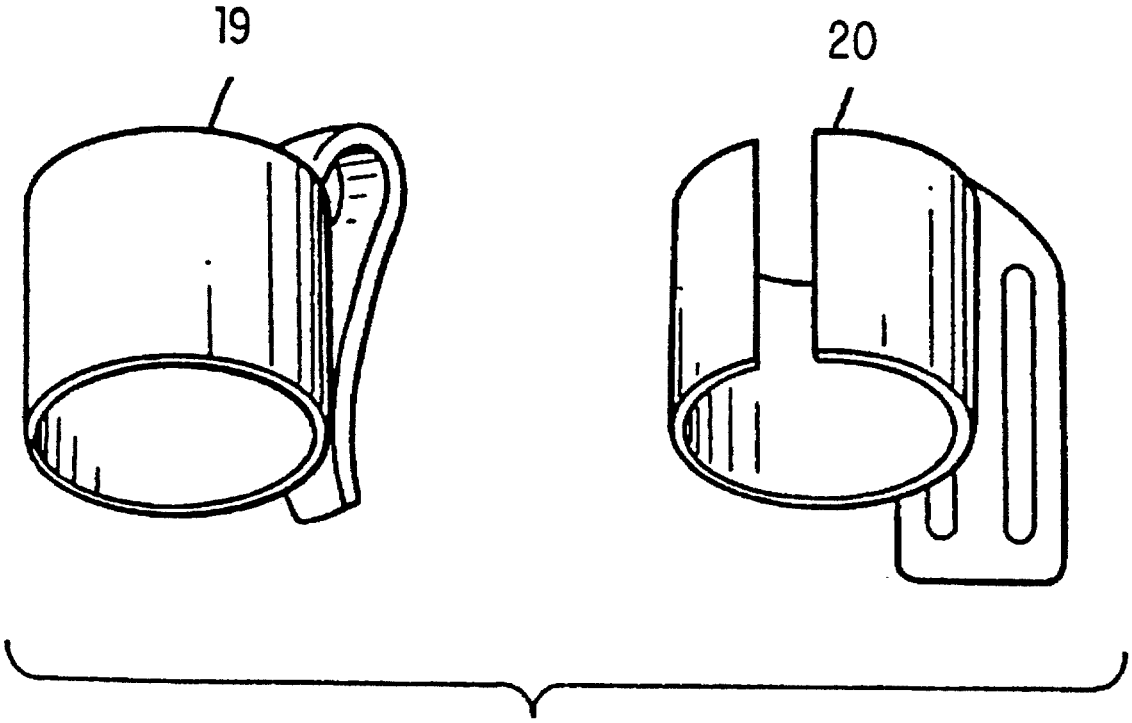

A resilient spring clip 6 may be provided on the lightwand component 1, in order to give the user of the device 12 a means by which the device can be attached to the user's body, such as on a waistband or on a pocket. Applicant notes that the clip 6 may be omitted without effecting the operability or usefulness of the device 12, and other types of attachment means as shown in FIGS. 5–7.

The lightwand component 1 is provided with one or more longitudinally extending slits 5, which run almost the entire length of the component 1, that is, from the distal end 4 of the lightwand component 1 to a point near the light projecting end 9 of the flashlight 11. The slit or slits 5 give the lightwand component 1 the capability of partially curling around itself at its distal end 4. It is the curling feature that gives Applicant's lightwand component 1 its unique feature as herein described. the curling at distal end 1 causes the component to define a conical shape, when in the operable configuration and affixed to the light projecting end 9 of the flashlight 11. Applicant notes that this conical shape improves the visibility of the device 12 and improves the overall appeal of Applicant's device 12. The slit 5 also allows the lightwand component 1 to open-up or expand at the distal end 4 so as to permit entry and seating of the flashlight 11, when the device 12 is in its holstered or stowed position, as shown in FIG. 2.

FIG. 2 shows Applicant's invention 12 in the holstered or stowed configuration, that is, where the flashlight 11 is positioned within the internal confines of the lightwand component 1. In order to accommodate the flashlight 11 properly, the slits 5 permit the distal end 4 of the component to uncurl and open to its full diameter from the conical shape shown in FIG. 1. The full diameter of the component 1 is the same or greater than the body of the flashlight 11.

The plastic material of which the component 1 is molded is chosen for its resiliency, among other things, so that the distal end 4 uncurls smoothly, thereby accommodating the body of the flashlight 11, and then recurls reliably.

Unlike the lightwand configuration shown in FIG. 1, the holstered configuration shown in FIG. 2, clearly illustrates that the body of the lightwand component, is retained in an open position by the body of the flashlight 11 which is enclosed therein. But when the flashlight 11 is removed from the component 1, the lightwand component 1 relaxedly contracts upon itself, thereby resulting in a conical shape having a markedly smaller diameter, especially at its distal end 4.

Figure 3:
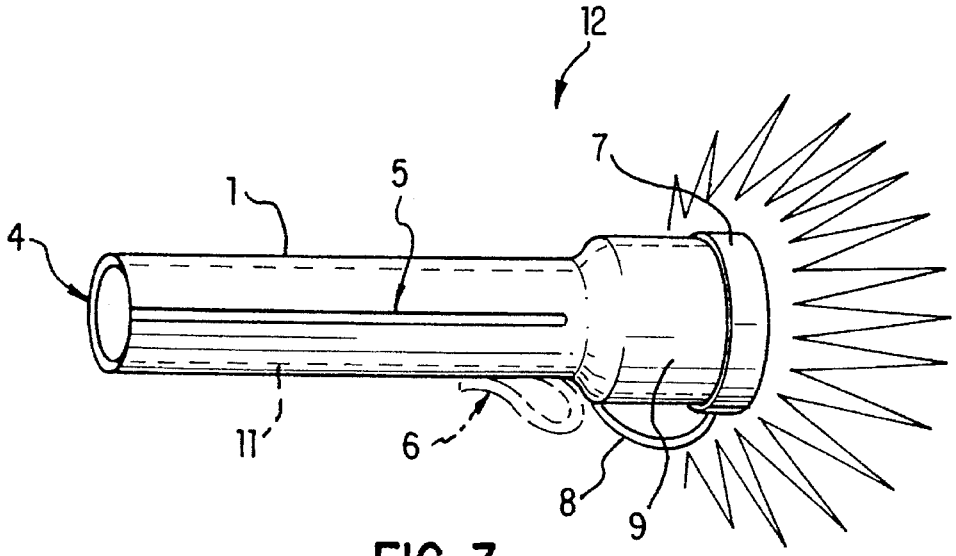
FIGS. 3 and 4 show other holstered configurations of Applicant's device.

FIG. 3 shows Applicant's device 12 in the holstered configuration, with the cap 7 in place over the component 1. Cap 7, as shown here, is molded of a translucent material so as to disperse rays of light emanating from the light projecting end 9 of the flashlight 11. When in place the cap 7 protects the light projecting end 9 from the harmful effects of rain, dust, dirt and the like.

Figure 4:
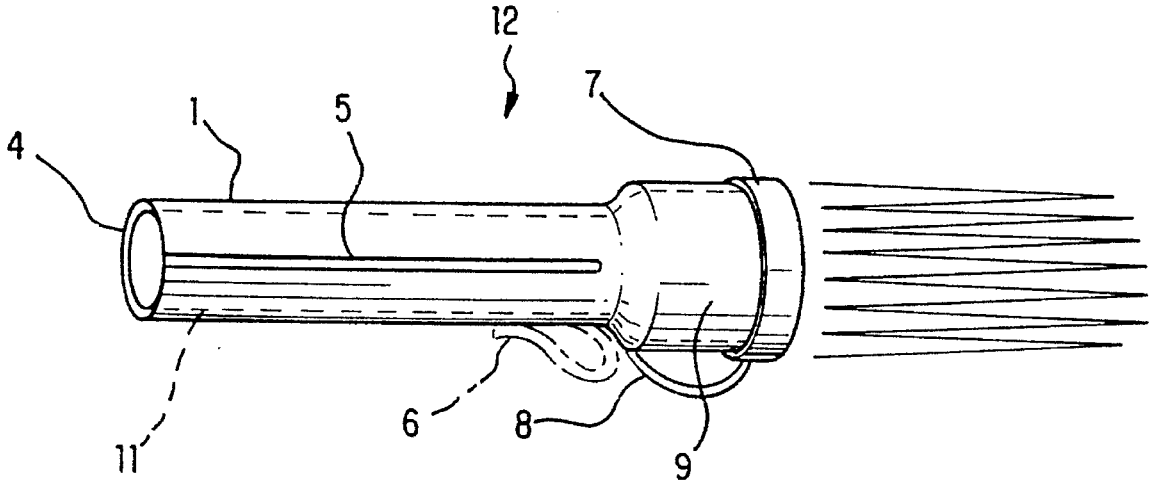

FIG. 4 shows Applicant's device 12 in the holstered position, with the cap 7 in place over the component 1. But unlike the cap 7 shown in FIG. 3, the cap 7 in FIG. 4 is completely transparent, that is molded of a clear plastic or perhaps made of glass, so as to allow light rays from the flashlight to pass through.

As shown on FIG. 3 and 4 the shaped receptacle of the holster-wand 12 when it is used as a flashlight holster, is shown containing therein a flashlight 11, and the one or more axial slits which have been incorporated. The distal end 4 is open, the light output end of the installed flashlight 11 extends past the first end of the component 1, to facilitate ease of flashlight removal and the protective end cap 7 has an elongated shape to provide for securement and sealing while accommodating the extended flashlight end 9.

FIGS. 5–7 show other means for attaching Applicant's device 12, other than by clip 6, to the person of a user, all of which are elaborated upon in Applicant's patent application Ser. No. 08/195,476 filed on Feb. 14, 1995, which is herein incorporated by reference.

FIG. 5 shows a sleeve 13 and key 14 attachment arrangement, wherein the sleeve 13 slips over the outside of the component 1. Note that the key 14 is integral with the sleeve 13. The key 14, in turn, fits a key hole 16 on a bracket assembly 15, and the bracket 15 secured onto the user's belt or pocket.

FIG. 6 shows a hook and loop type attachment assembly, where either the hook 17 member is fastened to the component 1 and the other member 18 is clipped onto the user's belt or pocket.

FIG. 7 shows basic sleeve type arrangements. Sleeve 19 includes a clip such as shown on FIGS. 1–3, and sleeve 20 includes a bracket which can go on the user's belt.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. A hand held optical signalling attachment for a flashlight, said flashlight having a body portion and a light projecting end, the attachment comprising: a resilient, translucent, thin-walled linear tube having at least one longitudinal slit extending substantially the entire length of said tube, from a first end to near a second end, said second end having a greater diameter than said first end, said second end having a gradually tapered region reaching from a length along said tube from said second end proximate to said slits, said greater diameter adapted to receive therein the light projecting end of said flashlight by interference fit, the diameter of said first end being equal to the diameter of said body portion of said flashlight so as to accommodate therein said body portion, whereby said first end automatically assuming a conical shape when said flashlight is removed from within said tube.

2. The attachment of claim 1 wherein said tube is color coded.

3. The attachment of claim 1, wherein said tube is transparent.

4. The attachment of claim 1, wherein said attachment includes a cover device adapted for placement over said second end while said flashlight is received within said attachment, said cover device connected to said attachment.

5. The attachment of claim 4, wherein said cover device is color coded translucent, or transparent.

6. The attachment of claim 1, including means for securing said attachment.

* * * * *